US005398529A

United States Patent [19]

Goldman et al.

[11] Patent Number: 5,398,529

[45] Date of Patent: * Mar. 21, 1995

[54] TAMPER-RESISTANT LOCK

[76] Inventors: David S. Goldman, 20 Fruit St., Hopkinton, Mass. 01748; Craig L. Krigsman, Apartment #21, 46 Westland Ave., Boston, Mass. 02115

[ * ] Notice: The portion of the term of this patent subsequent to Apr. 7, 2009 has been disclaimed.

[21] Appl. No.: 863,858

[22] Filed: Apr. 6, 1992

Related U.S. Application Data

[63] Continuation-in-part of Ser. No. 666,856, Mar. 7, 1991, Pat. No. 5,101,646.

[51] Int. Cl.[6] ..... E05B 67/22

[52] U.S. Cl. ..... 70/38 A; 70/39; 70/53

[58] Field of Search ..... 70/38 A, 38 B, 38 C, 70/38 R, 39, 26, 53

[56] References Cited

U.S. PATENT DOCUMENTS

| | | | |
|---|---|---|---|
| 263,212 | 8/1882 | Pettibone . | |
| 410,027 | 8/1889 | Rueckert . | |
| 1,542,016 | 6/1925 | Stull . | |
| 1,616,449 | 2/1927 | Horak . | |
| 2,889,451 | 6/1959 | Longo | 240/52 |
| 3,739,607 | 6/1973 | Smedley | 70/18 |
| 3,754,418 | 8/1973 | Miller | 70/18 |
| 3,924,426 | 12/1975 | Zane et al. | 70/18 |
| 3,967,475 | 7/1976 | Zane | 70/18 |
| 3,979,931 | 9/1976 | Man | 70/38 A |
| 4,070,879 | 1/1978 | Thompson | 70/20 |
| 4,155,231 | 5/1979 | Zane et al. | 70/18 |
| 4,290,280 | 9/1981 | Yun | 70/38 A |
| 4,545,224 | 10/1985 | Zane | 70/39 |
| 4,584,855 | 4/1986 | Burlingame | 70/38 |
| 4,881,387 | 11/1989 | Kortenbrede | 70/39 |
| 4,918,949 | 4/1990 | Newbold | 70/38 |
| 4,964,706 | 10/1990 | Cook | 350/505 |
| 5,010,746 | 4/1991 | Zane et al. | 70/39 |
| 5,092,142 | 3/1992 | Zane et al. | 70/39 |
| 5,101,646 | 4/1992 | Goldman et al. | 70/38 A |

FOREIGN PATENT DOCUMENTS 2706302 2/1977 Germany .

*Primary Examiner*—Peter M. Cuomo
*Assistant Examiner*—Suzanne L. Dino
*Attorney, Agent, or Firm*—Weingarten, Schurgin, Gagnebin & Hayes

[57] ABSTRACT

A lock is provided having a thick U-shaped shackle, a transverse housing for receivably locking extending ends of the shackle, a pair of longitudinal members which lockably intersect the shackle ends and which are actuated by a lock protected within the intermediate portion of the housing. In an exemplary embodiment of the lock, the shackle and housing are constructed of substantially thick tubular metal, and the shackle ends may be conformed to openings in the housing. The longitudinal members may be extended post members which intersect inserted shackle ends or may be forked members which slidably engage flat portions on inserted shackle ends. The locking mechanism may be activated through a rack-and-pinion, cam-and-pin, or hook-and-pin assembly, and may further comprise shackle ends having flat sections conformed to the housing openings to prevent rotation. In another exemplary embodiment of the lock, the lock incorporates a second U-shaped shackle on the opposite side of the housing from the first shackle. The compact and integral design affords improved resistance to tampering such as by shattering or cutting/twisting methods.

19 Claims, 7 Drawing Sheets

TAMPER-RESISTANT LOCK

RELATED APPLICATION

This application is a continuation-in-part application of application Ser. No. 07/666,856, filed Mar. 7, 1991, and now U.S. Pat. No. 5,101,646.

FIELD OF THE INVENTION

The invention relates to the field of locks, and more particularly to locks of the type used for bicycles and motorcycles.

BACKGROUND OF THE INVENTION

Locks having relatively large U-shaped brackets or shackles in combination with elongated housings have been used for preventing tampering and thwarting bicycle/motorcycle thieves. Early versions of U-shaped locks, such as the kind exemplified in U.S. Pat. Nos. 3,754,418, 3,924,426, and 3,967,475, were fabricated from flat pieces. These were susceptible to cutting by long-armed cutters. Later versions, such as those exemplified in U.S. Pat. Nos. 4,155,231, 4,545,224, and 4,918,949, were fabricated in a tubular shape for added resistance against cutting.

The U-shaped lock design nevertheless remains susceptible to tampering. One manner of tampering has been to cut the U-shaped bracket and wobble and twist the severed pieces of the bracket to chosen the ends of the bracket held in the housing. In each of the tubular designs cited in the patents above, at least one end of the U-shaped shackle is removably attached to the housing by either a detente or a bent hook end which, after the shackle is cut, can be wiggled within the housing and thus out of the gasp of the detente or hook. Consequently, the cut pieces of the shackle can be pried apart and the lock defeated.

Another way of defeating the lock is to spray the housing with freon to render the metal brittle, and then to shatter the metal of the housing and pry apart the ends of the U-shaped bracket. In many of the tubular lock designs in the patents mentioned, a lock or detente mechanism is located at the end of the housing there it is vulnerable to shattering and otherwise exposed to having leverage applied to pry the lock apart.

U.S. Pat. No. 4,584,855 teaches a U-shaped lock in which a cylinder lock is located within the housing between the openings which lockably receive the shackle ends. However, the lock require an access port to permit the key to be inserted into the lock, thereby disrupting the structural integrity of the housing. The disclosed detente cavities or gaps in the shackle end inserted into the housing, like locks of the above-mentioned prior art patents, do not substantially resist defeat of the lock by cutting and twisting. Furthermore, the lock requires numerous internal moving parts.

A lock having either a single or double U-shaped shackle is thus needed for defeating breakage by shattering and for resisting tampering by cutting and twisting.

SUMMARY OF THE INVENTION

In surmounting the disadvantages of prior art U-shaped locks, the invention provides a lock having either one or two generally tubular shackles, and a housing in which a lock mechanism, protected within a thick protective housing and located between the shackle receptacle openings, activates a pair of longitudinal members which engage a shackle end inserted into the housing. The members may also be formed in the shape of posts which intersect the diameter of the inserted shackle ends or forks which slidably engage with flat grooves on the shackle ends.

The locking mechanism may comprise a rack-and-pinion assembly, cam-and-pin assembly, or hook-and-pin assembly which provides simultaneous engagement of both shackle ends within the protection of the housing. The shackle ends inserted into the housing openings may contain flat portions to provide further resistance against twisting of a cut shackle. The locking mechanisms are compatible with either a single or a double shackle lock configurations.

The construction of the housing requires relatively few parts and yet affords a substantial improvement in structural integrity and resistance to tampering by shattering or cutting/twisting methods.

BRIEF DESCRIPTION OF THE DRAWINGS

A more complete understanding of the present invention and attendant advantages and features thereof will be more readily understood by reference to the following detailed description when considered in conjunction with the accompanying drawings wherein.

DETAILED DESCRIPTION OF THE INVENTION

Figure 1:
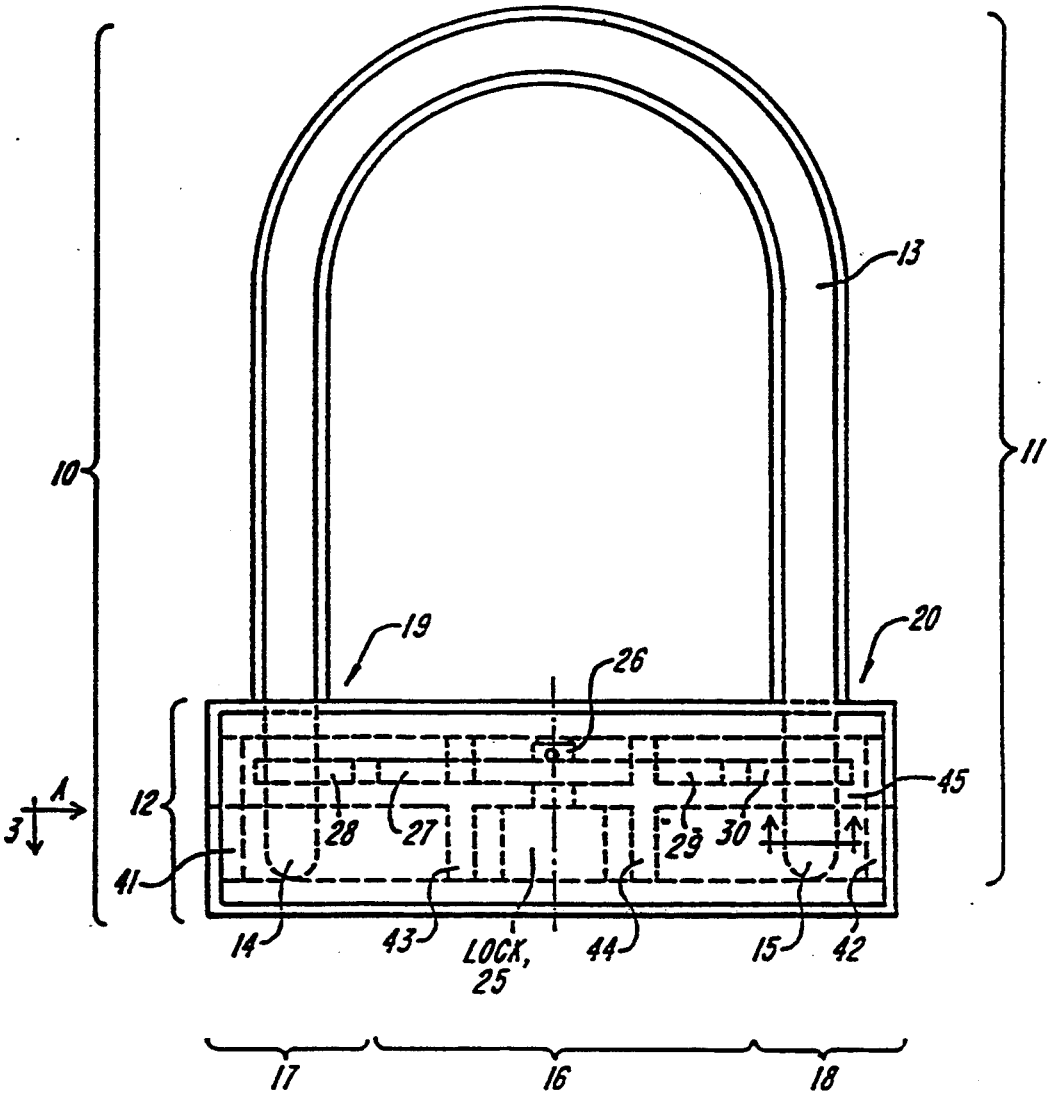
FIG. 1 front plan view of the U-shaped lock of the invention.

Reference is made to the drawings wherein like numerals designate corresponding or similar elements throughout the several views. There is shown in FIG. 1 an exemplary embodiment of the U-shaped lock 10 of the invention which is comprised of a U-shaped body 11 and a transverse housing 12 mated together. The shackle 11 is comprised of a U-shaped body portion 13 which is generally extended so as to permit the lock to be used with large or spaced objects, such as bicycle or motorcycle frames and wheels. The U-shaped body portion 13 has a first longitudinal extending end 14 and a second longitudinal extending end 15. The first extending end 14 has a perpendicularly disposed receptacle channel 32. The second extending end 15 similarly has a perpendicularly disposed receptacle channel 34. In an exemplary embodiment of the invention, the channels 32/34 run through the entire diameter or width of the shackle extending ends 14/15.

The shackle 11, shackle body 13, and extending ends 14/15 may be formed in any cross-sectional shape or shapes. A preferred tubular form is shown in FIG. 1. The shackle 11 is preferably made of hard material such as metal, and should be made substantially thick to resist cutting and sawing. The design of the invention permits thick material to be used efficiently in the areas which most require structural integrity.

A transverse housing 12 which lockably mates to the shackle 11 is comprised of a transverse body portion 16, a first end 14 having an opening or receptacle 19 for receiving one of the longitudinal extending ends 14 of the shackle 11, and a second end 15 having an opening or receptacle 20 for receiving the other of the longitudinal extending ends 15 of the shackle 11. The transverse housing 12 is preferably formed of hard material, such as metal, in generally tubular form. It should be substantially thick to resist tampering such as by shattering or cutting.

The transverse housing 12 may be made of solid material which is drilled out to permit installation of a lock assembly and to permit lockable mating with the shackle. Alternatively, the transverse housing may be made out of a thick tube, as shown in FIG. 1, with an internal matrix shown generally at 41–45 to Provide structural integrity. In an exemplary embodiment all the invention, solid end pieces 41 and 42 may be welded, glued, or otherwise affixed to the ends 17 and 18 of the tubular housing 12. A matrix, such as one having members 43 and 44, may be fixed within the intermediate housing portion 16 to provide further structural rigidity. A longitudinal matrix or brace member 45 can be fixed along the length of the transverse housing 12 so as to provide further rigidity and structural integrity as well as to provide a framework for mounting the locking mechanism as will be hereinafter described.

A lock 25 is located within the intermediate portion 16 of the transverse housing 12 between the receptacle openings 19 and 20. The lock 25 may be of the key-actuated type or the combination type known in the art, or of any other kind of mechanism which can fit within the dimensions of the housing 12. Connected to the lock 25 within the housing 12 is an actuator 26 which moves in response to the actuation of the lock 25 and in turn moves post members 27 and 29. Each of the post members 27 and 29 are connected to the actuator 26 and have longitudinal extending ends 28 and 30 conformed to fit into the receptacle channels 32 and 34 of the shackle ends 14 and 15 where the shackle 11 is mated to the housing 12. Preferably, the post member elongated ends 28 and 30 extend through the shackle end receptacle channels 19 and 20 when the lock 26 is actuated.

Figure 1A:
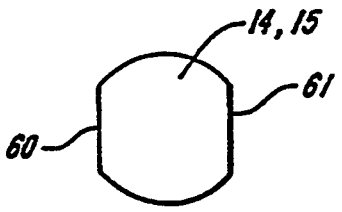
FIG. 1A is a cross-sectional view as indicated at C in FIG. 1 of a shackle end of an embodiment of the invention.

FIG. 1A, which is a view along C of FIG. 1, shows an exemplary embodiment of the invention in which the extended ends 14/15 of the shackle 11 have flat portions 60 and 61 which correspond with flat portions (not shown) in the corresponding openings 19/20 in the housing 12 to further prevent the shackle 11 from being rotated if it is cut. The flat sections 60 and 61 are preferably perpendicular to the direction in which the post members 28 and 30 intersect the shackle ends 14 and 15.

Figure 2:
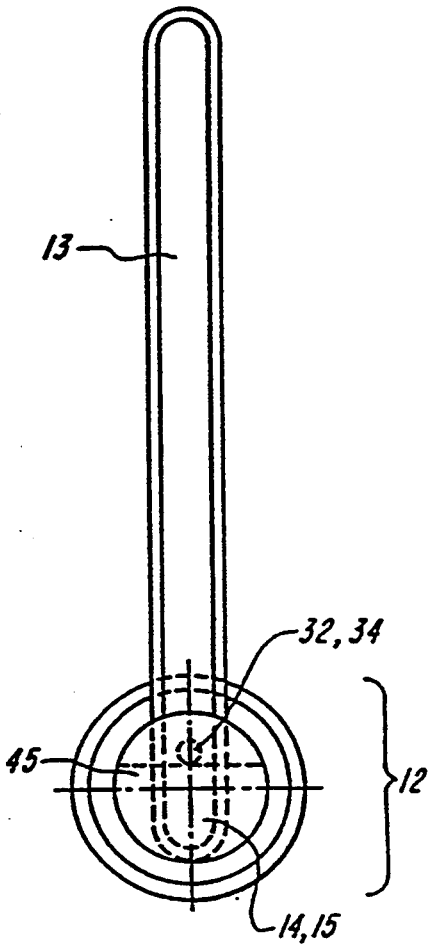
FIG. 2 is a view of the lock of FIG. 1 along direction A.

FIG. 2 shows the exemplary embodiment of the invention along direction A of FIG. 1. The longitudinal extending ends 14 and 15 of the shackle need not extend entirely through the body of the housing 12; the housing 12 therefore does not require a second set of openings. A flat longitudinal brace bar or matrix 45 may be fixed inside the housing 12 to provide structural support. The receptacle channels 32/34 of the shackle 11 are generally parallel to the axis of the transverse housing 12 in the tubular embodiment shown.

Figure 3:
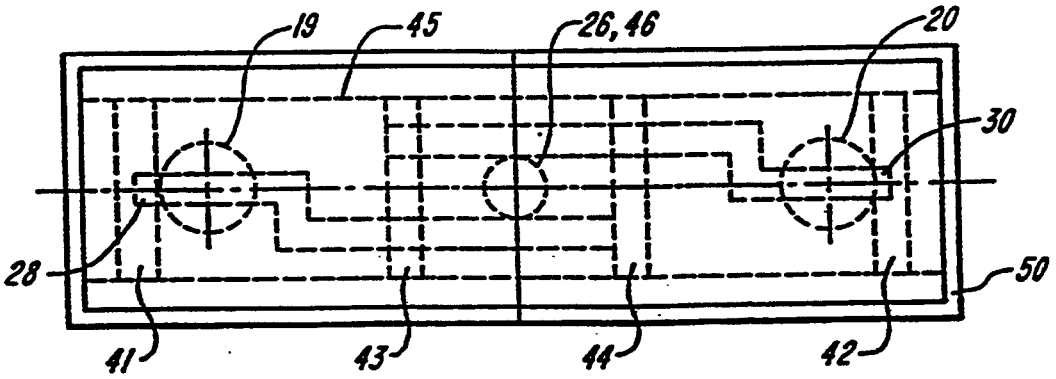
FIG. 3 is a view of the lock of FIG. 1 along direction B.

FIG. 3 shows a view of the lock along direction B of FIG. 1. Thus, in an exemplary embodiment of the invention, the housing 12 can be made with a relative minimum of internal parts and yet afford structural integrity and resistance to tampering and breakage. For example, matrix portions 43 and 44 may contain channels (not numbered) to hold and permit the slidable passage of the locking posts 27 and 29 so that their respective extended ends 28 and 30 are aligned with the receptacle channels 19 and 20 of the shackle ends 14 and 15. In addition the end pieces 28 and 30 may contain further receptacle holes (not numbered) for receiving the locking post extending ends 28 and 30 for further protection against defeat of the lock by shattering of the shackle and twisting of the shackle ends 14 and 15. The end pieces 28 and 30 may be sunk into the tubular housing 12 so that they are less susceptible to tampering.

The locking mechanism which comprises the lock 25, actuator 26, and post members 27/28 and 29/30 may include a variety of mechanisms which result in the lockable engagement of the shackle ends. For example, the actuator 26 may be a pinion which engages racks on the post members 27 and 28 in the manner of a car steering mechanism. Thus, when the actuator is turned in one direction, both post members 27/28 are moved outwardly to engage with the receptacle openings 32/34 of the shackle ends 14 and 15. When the actuator is turned in the other direction, both post members are retracted to permit removal of the shackle.

Figure 4:
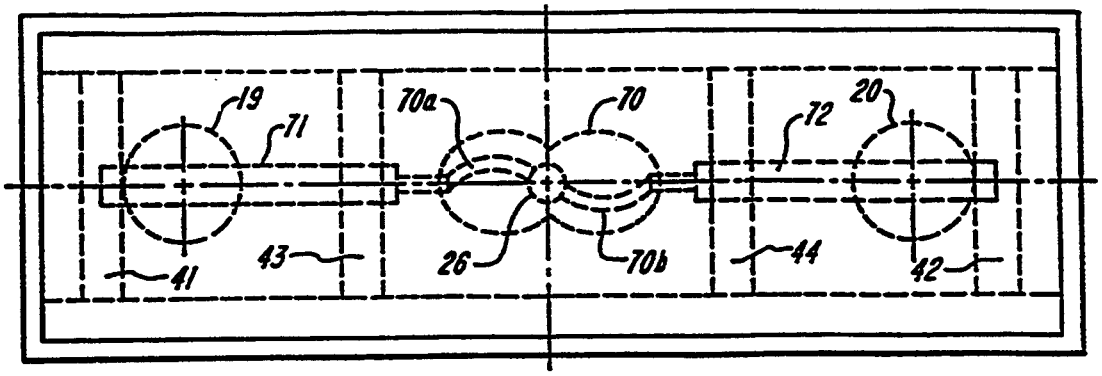
FIG. 4 is a top plan view of a housing having a cam-and-pin assembly.
Figure 5:
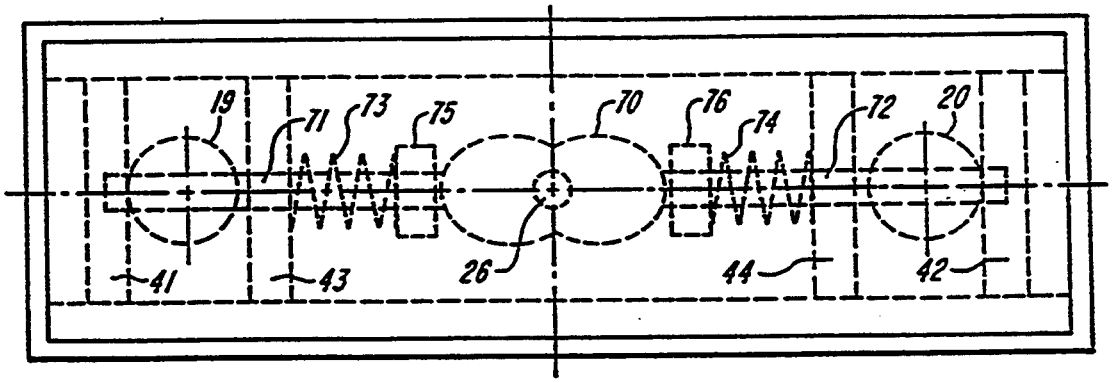
FIG. 5 is a top plan view of a housing having a cam-and-pin assembly with springs.

Alternatively, as shown in FIG. 4, the actuator 26 may be connected to a cam 70 having tracking grooves **70*a* and 70*b* for radially engaging push-rods or captive pins 71 and 72 and moving them inwardly and outwardly. The pins 71 and 72 may contain members which travel along grooves 70*a* and 70*b* so that the pins may thereby be pushed into and pulled from shackle ends located in the housing openings 19 and 20 when the cam is turned by the lock 25. FIG. 5 shows a further embodiment of the invention wherein a cam-and-pin assembly comprises a cam 70 which, when turned by the actuator 26, engages pins 71 and 72, pin heads 75 and 76 which directly contact the cam 70, and springs located between the pin heads 75 and 76 and matrix portion 43 and 44 to bias the pins 71 and 72 away from shackle ends 19 and 20** when the cam is returned to its original position.

In another embodiment of the invention, fork members which grip external flat portions located on the shackle ends may be used instead of the post members which intersect the shackle ends. The engagement between the flat portions and fork members would also prevent twisting of a shackle in the housing opening in the event that the shackle was cut.

Figure 6:
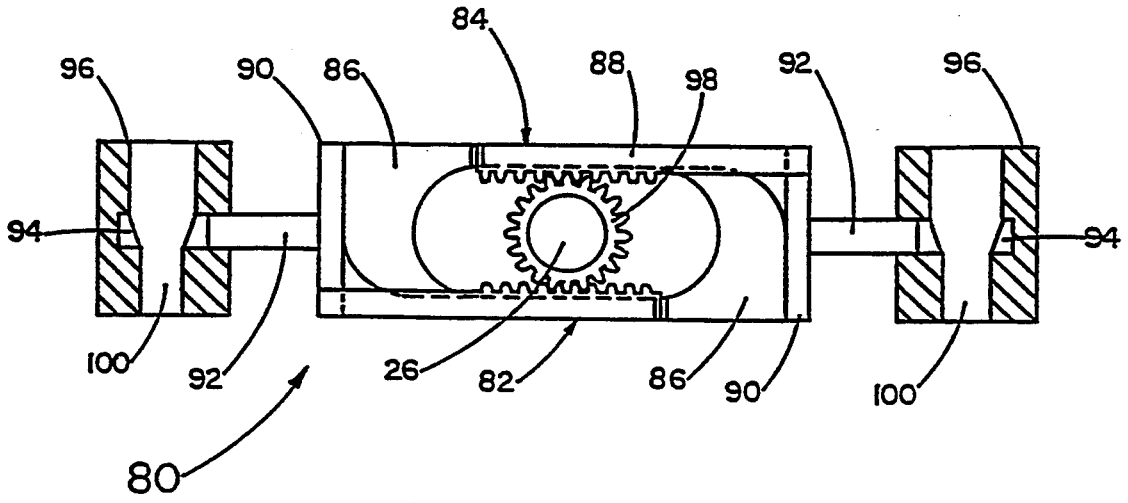
FIG. 6 is a top plan view of a hook-and-pin assembly in the open position.
Figure 8:
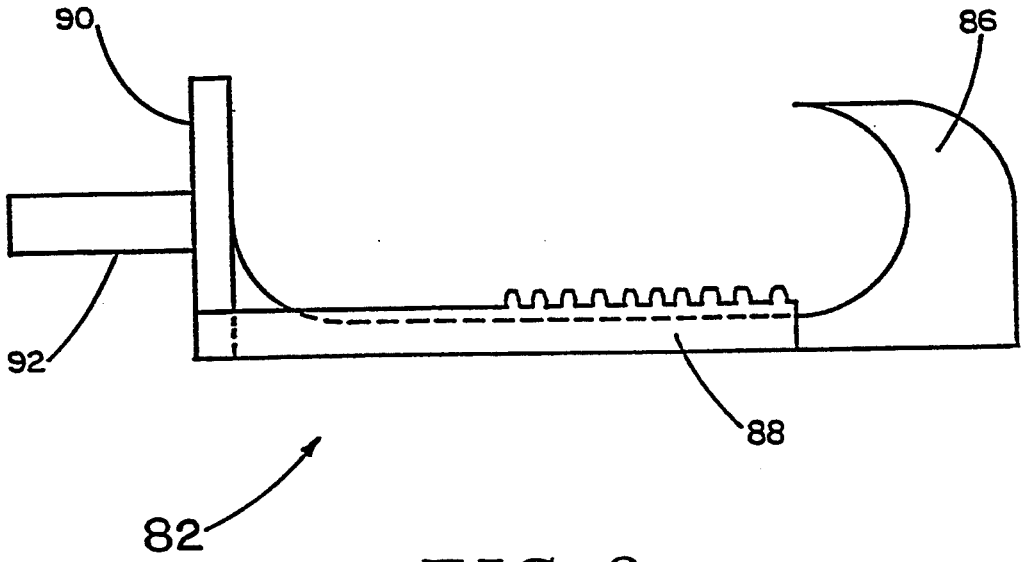
FIG. 8 is a top plan view of one half of the hook of the assembly of FIGS. 6 and 7.

A top plan view of another locking mechanism, hereinafter referred to as a hook-and-pin assembly 80, is shown in FIG. 6. The assembly 80, shown in the open or unlocked state, comprises two separate mirror image pieces 82 and 84 having substantially identical structure and function. Therefore, the description of one piece applies to the other piece in like manner. A single piece 82 is shown in FIG. 8. Each unitary piece 82 and 84 comprises a hook 86, a bar 88, an end plate 90, and a locking pin 92. The two pieces 82 and 84 are centered about an actuator 26. The locking pin 92 is slidably engaged in a channel 94 in an end piece 96.

Figure 7:
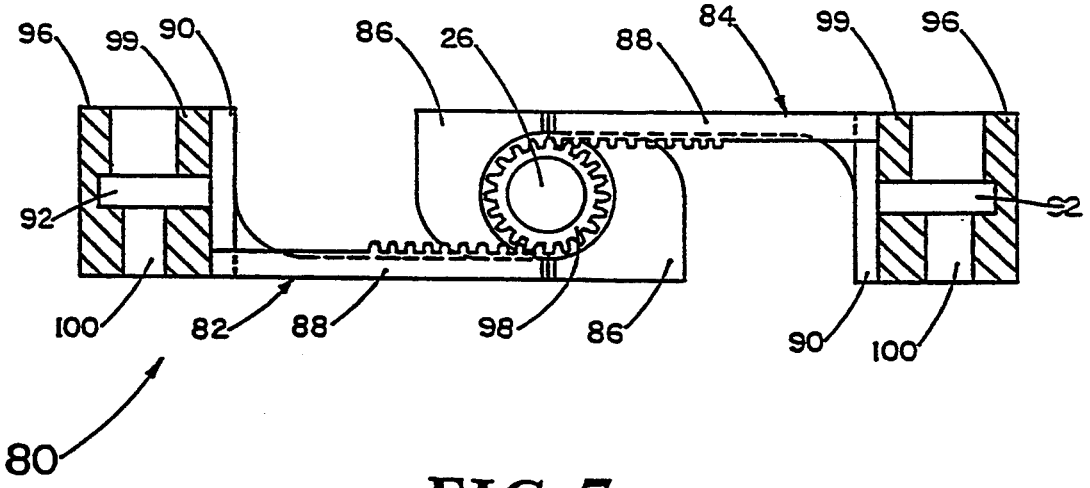
FIG. 7 is a top plan view of a hook-and-pin assembly in the closed position.

The actuator 26 may include a variety of mechanisms which cause the two pieces 82 and 84 to move. In one embodiment, a pinion gear 98, having teeth coupled to the actuator 26 engages a rack having teeth, incorporated on each bar 88. Thus, when the actuator 26 is turned in one direction, both bars 88 move outward simultaneously to push the locking pins 92 through the channels 94 and openings in the shackle ends 14 and 15 which have been inserted through openings 100 in the transverse housing 12 and into the end pieces 96. Further travel of the pieces 82 and 84 is inhibited when the end pieces 90 make contact with a wall 99 of the end piece 90. The hook-and-pin assembly 80 is then in the closed or locked position as shown in FIG. 7. This configuration is especially strong in the closed position due to the shape of the hooks 86. The curved shape of the hooks 86 allows them to completely surround the actuator 26 and thereby strengthen it.

Figure 9:
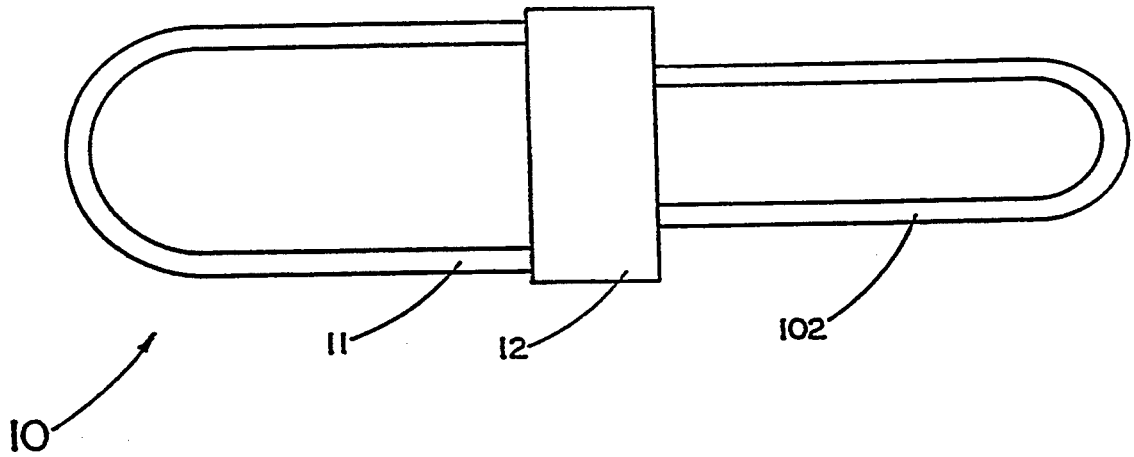
FIG. 9 is a front plan view of the lock of FIG. 1 having a double shackle.
Figure 11:
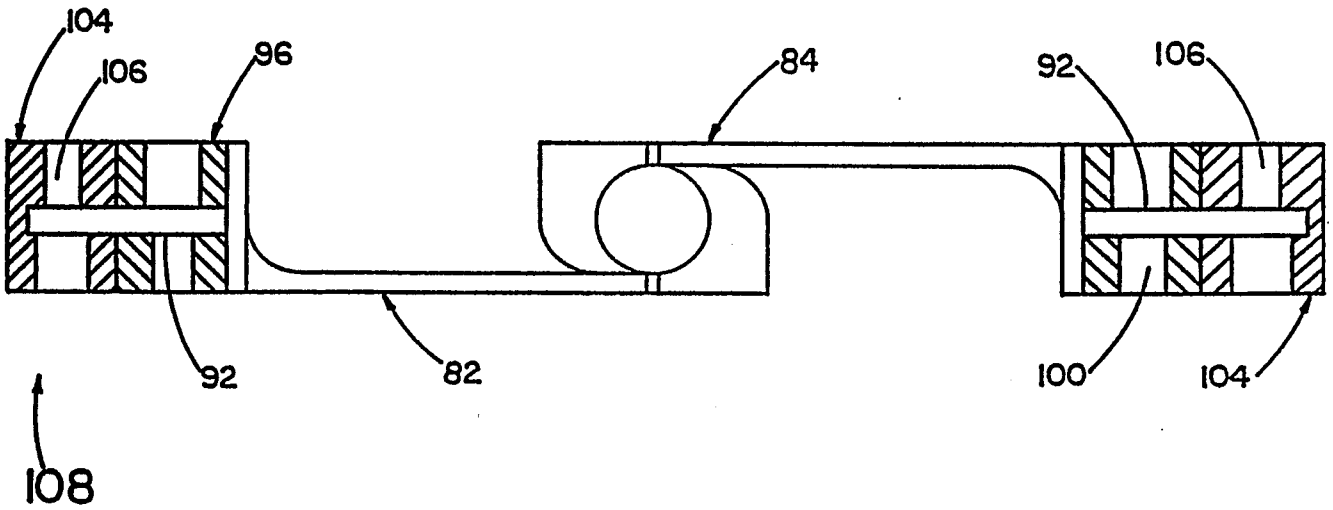
FIG. 11 is a top plan view of a hook-and-pin assembly for the double shackle lock of FIG. 9 in the closed position.

FIG. 9 is a front plan view depiction of another embodiment of the invention which is configured to lock a second shackle 102. All of the locking mechanisms referenced hereinabove, are operable with both a first and second shackle 11 and 102, by adding a second set of receptacles or end pieces 104, having openings 106 to receive the shackle ends of the second shackle 102, and by extending the length of the locking pins 92, as shown in FIGS. 11 and 12.

Figure 10:
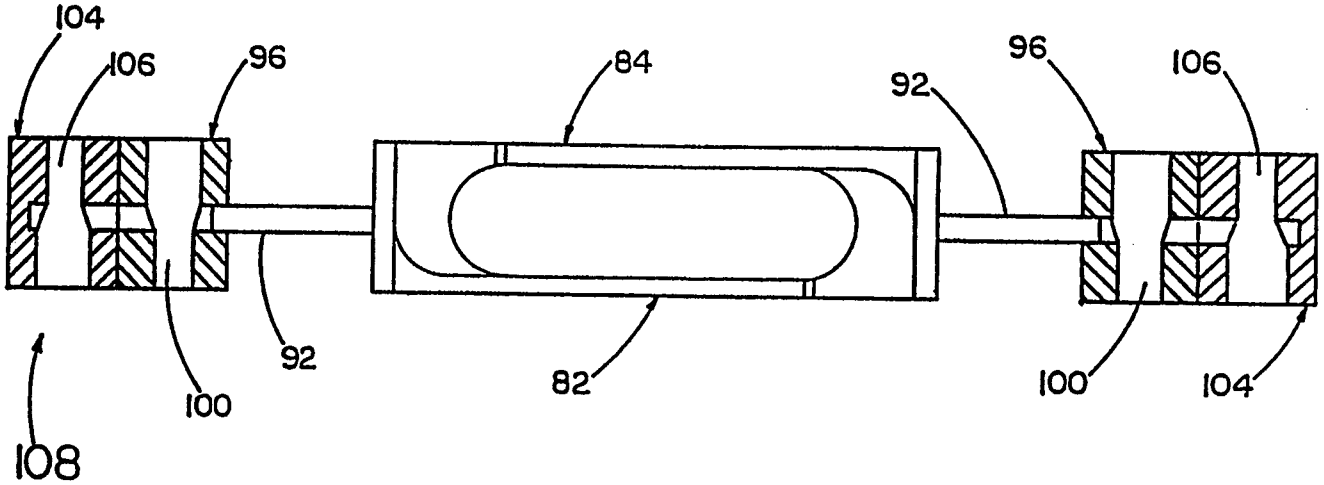
FIG. 10 is a top plan view of a hook-and-pin assembly for the double shackle lock of FIG. 9 in the open position.

FIG. 10 illustrates a locking mechanism incorporating a hook-and-pin assembly 108 in a double shackle configuration. A first shackle 11 is inserted into one side of the lock housing, and a second shackle 102 is inserted into the opposite side. In this embodiment, the first shackle 11 is larger than the second shackle 102 in order to facilitate alignment of the shackle ends to permit a single locking pin 92 to pass through the end of the second shackle 102 and then through the end of the first shackle 11. The assembly 108 operates in a similar manner to the assembly 80 of FIGS. 6 and 7 with the addition of a second set of end pieces 104, and an elongated locking pin 92. FIG. 12 illustrates the locked position.

In lieu of a second set of end pieces 104, a pair of single end pieces may be used, each of which having an opening on each side of the transverse housing 12. Each of the single end pieces receives a shackle end from the first shackle 11 and a shackle end from the second shackle 102. The two shackle ends are accommodated in a single end piece by either enlarging the diameter of the end piece or by milling down the shackle ends to half thickness. This configuration permits a single pin 92 to pass through openings in both shackle ends, thereby locking them into position. It also permits substantially identical sized shackles 11 and 102 instead different sized shackles.

In addition to the rack-and-pinion, cam-and-pinion, post member, fork member, and hook-and-pin assemblies described above, other mechanisms which permit all of the shackle ends to be lockably secured within the housing are contemplated within the scope of the invention. The invention permits the lock to be accessible from any direction desired on the radial surface of the intermediate housing portion. For example, the lock could be disposed through an opening 46 towards the U-shaped shackle to provide further protection against direct blows of a hammer or other striking implements so as to resist shattering. The housing may be encased in a layer of protective material 50 such as plastic or rubber to enhance durability and provide insulation and additional hindrance to tampering.

A variety of modifications and variations of the present invention are possible in light of the above teachings. It is therefore to be understood that, within the scope of the appended claims, the present invention may be practiced otherwise than as specifically described hereinabove.

We claim:

1. A U-shaped lock comprising:

a U-shaped shackle having first and second extended ends, each having at least one generally transverse lock channel which permits a bar to be inserted completely through the extended end;

a transverse housing having first and second ends each having a receptacle opening corresponding to and alignable with said shackle extending ends for lockable mating therewith, said transverse housing having an intermediate portion located between said ends;

an actuatable lock cylinder located within said transverse housing intermediate portion;

a pinion gear connected to said lock cylinder, said gear having teeth for engaging cooperative rack gear teeth;

a first and a second locking mechanism located within said transverse housing intermediate portion and connected to said actuatable lock cylinder for movement in response to actuation of said lock cylinder, each of said first and second locking mechanisms having rack gear teeth cooperative with said pinion gear teeth and operative to permit movement of each locking mechanism in a direction opposite to the other, and each further comprising a pin which is inserted completely through a corresponding one of said at least one generally transverse lock channel of said shackle extended end when said shackle is mated to said transverse housing and said lock cylinder is actuated.

2. The lock of claim 1, wherein the cross-sectional shape of said U-shaped shackle and said transverse housing is generally tubular.

3. The lock of claim 1, wherein said lock cylinder requires a key to change said lock cylinder between actuated and unactuated states.

4. The lock of claim 1, wherein said shackle and said transverse housing are made of metal.

5. The lock of claim 1, wherein said transverse housing further comprises a first and a second end piece for receiving said first and said second shackle extended ends.

6. The lock of claim 1, wherein said transverse housing further comprises an internal matrix for structural bracing of said transverse housing.

7. The lock of claim 6, wherein said matrix contains channels for slidably mounting said first and said second locking mechanisms, said channels aligning said pin of each of said first and second locking mechanisms to slidably engage with said lock channels of said shackle ends when said shackle is mated to said transverse housing.

8. A double shackle lock comprising:

a first U-shaped shackle comprising:

a first locking end, including a first generally transverse lock channel permitting a first pin to be inserted completely through said first locking end; and a second locking end, including a second generally transverse lock channel permitting a second pin to be inserted completely through said second locking end;

a second U-shaped shackle comprising:

a third locking end, including a third generally transverse lock channel permitting said first pin to be inserted completely through said third locking end; and a fourth locking end, including a fourth generally transverse lock channel permitting said second pin to be inserted completely through said fourth locking end;

a transverse housing comprising:

a first side, comprising a first housing end for lockable mating with said first locking end, and a second housing end for lockable mating with said second locking end and said fourth locking end;

a second side, comprising a third housing end for lockable mating with said third locking end and a fourth housing end for lockable mating with said fourth locking end;

an actuatable lock cylinder located within said transverse housing between said first housing end and said second housing end;

a pinion gear responsive to the movement of said actuatable lock cylinder;

a first and a second locking means slidably mounted within said transverse housing, each of said first and second locking means including rack gear teeth which engage with said pinion gear, said first and said second locking means responsive to movement of said pinion gear;

a first pin responsive to movement of said first locking means, said first pin insertable through said first and said third locking ends and thereby preventing their withdrawal from said transverse housing; and a second pin responsive to movement of said second locking means, said second pin insertable through said first and said third locking ends and thereby preventing their withdrawal from said transverse housing.

9. The lock of claim 8, each of said first and said second locking means further comprising an end plate for supporting said first pin and said second pin, said end plate limiting movement of said first and said second pins.

10. The lock of claim 8, wherein the cross-sectional shape of each of said first and said second U-shaped shackle is generally tubular.

11. The lock of claim 8, wherein said actuatable lock cylinder requires a key to change said actuatable lock cylinder between actuated and unactuated states.

12. The lock of claim 8, wherein said first and said second U-shaped shackles and said transverse housing are made of metal.

13. The lock of claim 8, said transverse housing further comprising an internal matrix for structural bracing of said transverse housing.

14. The lock of claim 13, wherein said matrix contains channels for slidably mounting said first and said second locking means, said channels aligning said pin of each of said first and second locking means to slidably engage with said lock channels of said shackle ends when said shackles are mated to said transverse housing.

15. A U-shaped lock comprising:

at least one U-shaped shackle, each having first and second extended ends, each of said first and second extended ends having at least one generally transverse lock channel which permits a bar to be inserted completely through said first and second extended ends;

a transverse housing having first and second ends, each of said first and second ends having at least one receptacle opening corresponding to and alignable with said first and second extended ends of said at least one U-shaped shackle;

an actuatable lock cylinder located within said transverse housing intermediate portion;

a cam having tracking grooves connected to said actuatable lock cylinder, said cam movable in response to actuation of said actuatable lock cylinder;

a first and a second locking mechanism located within said transverse housing intermediate portion, each of said first and second locking mechanisms comprising an engagement means slidably disposed within said tracking grooves of said cam, and said bar which is inserted completely through said at least one generally transverse lock channel of said first and second extended ends of said at least one U-shaped shackle.

16. The lock of claim 15, wherein said cam has two lobes.

17. A U-shaped lock comprising:

at least one U-shaped shackle, each having first and second extended ends, each of said first and second extended ends having at least one generally transverse lock channel which permits a bar to be inserted completely through said first and second extended ends;

a transverse housing having first and second ends, each of said first and second ends having at least one receptacle opening corresponding to and alignable with said first and second extended ends of said at least one U-shaped shackle;

an actuatable lock cylinder located within said transverse housing intermediate portion;

a double lobed cam connected to said acutatable lock cylinder, said double lobed cam movable in response to actuation of said actuatable lock cylinder;

a first and a second locking mechanism located within said transverse housing intermediate portion, each of said first and second locking mechanisms comprising a cam engagement means in slidable contact with the surface of said double lobed cam and said bar which is inserted completely through said first and second extended ends of said at least one U-shaped shackle.

18. The lock of claim 17, wherein said cam engagement means further comprises a bias means to bias said bar inward toward said double lobed cam.

19. The lock of claim 18, wherein said bias means is a spring.

* * * * *